US008986461B2

(12) United States Patent
Hischier et al.

(10) Patent No.: US 8,986,461 B2
(45) Date of Patent: Mar. 24, 2015

(54) DE-CARBONIZING PROCESS FOR COMBUSTION COMPONENT CLEANING

(71) Applicant: Illinois Tool Works, Inc., Glenview, IL (US)

(72) Inventors: Mark E. Hischier, Irwindale, CA (US); Gregory Hewgill, Irwindale, CA (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 14/216,450

(22) Filed: Mar. 17, 2014

(65) Prior Publication Data

US 2014/0261555 A1 Sep. 18, 2014

Related U.S. Application Data

(60) Provisional application No. 61/793,159, filed on Mar. 15, 2013.

(51) Int. Cl.

| | |
|---|---|
| ***B08B 7/00*** | (2006.01) |
| ***F02B 77/04*** | (2006.01) |
| ***C11D 7/50*** | (2006.01) |

(52) U.S. Cl.

CPC ..... *F02B 77/04* (2013.01); *C11D 7/5027* (2013.01); *C11D 7/5022* (2013.01); *C11D 7/5013* (2013.01)

USPC ..... 134/20; 134/22.1; 134/22.11; 134/22.12; 134/22.14; 134/22.18; 134/26; 134/34; 134/36; 134/42; 510/185; 510/187; 510/406; 510/407; 510/437

(58) Field of Classification Search

CPC ..... C11D 11/0041; C11D 9/02; C11D 3/187; C11D 3/2065; C11D 3/2072; C11D 7/50; C11D 7/5027; C11D 7/5022; C11D 7/5013; B08B 3/00; B08B 3/04; B08B 9/00; B08B 9/02; B08B 9/027; F02B 77/04

USPC ..... 510/185, 187, 406, 407, 437; 134/20, 134/22.1, 22.11, 22.12, 22.14, 22.18, 26, 134/34, 36, 42

See application file for complete search history.

(56) References Cited

U.S. PATENT DOCUMENTS

| | | | | |
|---|---|---|---|---|
| 5,776,880 | A * | 7/1998 | Mondin et al. | 510/365 |
| 2003/0040448 | A1 * | 2/2003 | Messina | 510/185 |
| 2007/0060491 | A1 * | 3/2007 | Bowsman et al. | 510/185 |
| 2013/0098404 | A1 * | 4/2013 | McNeil | 134/20 |

* cited by examiner

*Primary Examiner* — Bibi Carrillo

(74) *Attorney, Agent, or Firm* — Blue Filament Law PLLC; Avery N. Goldstein

(57) ABSTRACT

A cleaning composition and process to remove carbon deposits from combustion equipment components is provided. The de-carbonizing composition is packaged in certain embodiments in an aerosol propellant. The inventive composition is also readily used as a liquid or an atomized mist that is readily introduced into the intake manifold through a tube tolerant of engine inlet operational temperatures and conditions. The invention introduces the composition by a process that precludes the need for engine disassembly.

14 Claims, No Drawings

DE-CARBONIZING PROCESS FOR COMBUSTION COMPONENT CLEANING

RELATED APPLICATIONS

This application claims priority benefit of U.S. Provisional Application Ser. No. 61/793,159 filed Mar. 15, 2013; the contents of which are hereby incorporated by reference.

FIELD OF THE INVENTION

The present invention in general relates to combustion equipment maintenance and in particular to a cleaning composition and process to remove carbon deposits from an intake manifold of an engine.

BACKGROUND OF THE INVENTION

Gasoline Direct Injection (GDI) engines are becoming commonplace under the hood of modern vehicles. With the fuel injection arrangement of GDI, fuel enters the combustion chamber directly from injectors mounted in the cylinder head, much like a diesel engine, and thus the fuel completely bypasses the air induction system and intake valves during injection.

There are many advantages to gasoline direct injection systems. GDI engines commonly have more power and better fuel economy than multi-port fuel injected engines of similar size and configuration. One of the disadvantages is that deposits will accumulate on the "inlet side" of the intake valve and on the valve stems, due to residual exhaust gasses and crankcase ventilation. These deposits are not amenable to cleaning through the use of conventional fuel detergents since these surfaces are never contacted by fuel as surfaces are in multi-port fuel injection (MPFI) or throttle body injection (TBI) equipped engines. Thus, these deposits build quickly over time and eventually these deposits result in poor engine performance. Currently there is no convenient maintenance procedure to correct this problem. Affected vehicles require significant tear down and mechanical cleaning of the ports and valves. This is a costly operation requiring several hours of labor.

Despite the advantages of gasoline direct injection engines, the lack of a non-invasive and labor intensive maintenance procedure for cleaning engine deposits has made GDI a less desirable approach. Thus, there exists a need for a low cost product and non-invasive method for cleaning and maintaining gasoline direct injection engines.

SUMMARY OF THE INVENTION

A cleaning composition and process to remove carbon deposits from combustion equipment components is provided and in particular to cleaning an intake manifold of an engine. The de-carbonizing composition is packaged in certain embodiments in an aerosol propellant. The inventive composition is also readily used as a liquid or an atomized mist that is readily introduced into the intake manifold through a tube tolerant of engine inlet operational temperatures and conditions. The invention introduces the composition by a novel process that precludes the need for engine disassembly.

DETAILED DESCRIPTION OF THE INVENTION

The present invention has utility as a cleaning composition and process to remove carbon deposits from combustion equipment components. The de-carbonizing composition is packaged in certain embodiments in an aerosol propellant. The inventive composition is also readily used as a liquid or an atomized mist that is readily introduced into the intake manifold through a tube tolerant of engine inlet operational temperatures and conditions. The invention introduces the composition by a novel process that precludes the need for engine disassembly.

It is to be understood that in instances where a range of values are provided that the range is intended to encompass not only the end point values of the range but also intermediate values of the range as explicitly being included within the range and varying by the last significant figure of the range. By way of example, a recited range of from 1 to 4 is intended to include 1-2, 1-3, 2-4, 3-4, and 1-4.

By introducing a cleaning composition into the intake manifold of a gasoline engine or a diesel engine during engine operation, the inventive composition so applied degasses and wets the metal engine parts with the de-carbonizing cleaning composition. With the carbon deposit freed from engine surfaces, such deposits and the cleaning composition are carried into a combustion chamber of the engine, where these materials chemically react under combustion conditions. The inventive method for introducing the cleaning composition is in contrast to the prior art methods that either draw cleaning compositions through the fuel injectors or through a continuous input of cleaning compositions.

In a particularly embodiment, an inventive composition is sprayed into the intake manifold while the engine is running, the spray is then discontinued and the engine is then turned off. With the repetition of this process at a time interval between cycles of from 1 to 30 minutes, it has been surprising found that a greater amount of carbon is removed from engine components than is possible with conventional continuous flow or vacuum draw of cleaning compositions. The inventive process achieves significant results when the process is repeated 2 to 4 times. It is appreciated that the inventive process may be repeated more than 4 times as needed to remove a desired amount of carbon deposits.

Embodiments of the inventive carbon deposit removal process function with a variety of engine cleaning compositions, such as those conventional to the art that include at least one of fuel; detergent; and solvent such as aromatics (e.g. Aromatic 100, toluene, naphthalene), aprotics such as acetone, dimethylsulfoxide, or hexamethylphosphoramide. Conventional cleaning compositions that are propelled into an engine intake illustratively include those detailed in EP0397752.

In a particular embodiment of the inventive carbon deposit removal composition, a foaming aerosol product that is introduced into the intake manifold while the engine is running, and contacts the valves directly where the foam breaks, wetting the metal parts and deposits, cleaning the deposit build up from the ports and valves, and as described above, the cleaning agents, along with the dissolved deposits, are carried inside the combustion chamber with the incoming air flow, just like a normal port fuel injection (PFI) service and burned within the combustion chamber. A convenient aerosol package includes an extended hose and nozzle tip for easy insertion into the intake manifold. Use of embodiments of the inventive engine cleaning composition successfully restored smooth engine operation in rough-running engines, eliminating the misfire codes presented by on board vehicle engine diagnostics while improving engine idle and operation at all engine speeds.

A typical service process for using the inventive engine valve deposit removal composition is as follows. The application of the inventive composition should be done with the necessary care and safety measures when working around a running engine including the blocking of the vehicles wheels; ventilating the vehicles exhaust; and the use of personnel protection such as safety glasses and gloves. Prior to the use of the inventive deposit removal composition, a fuel system cleaner is recommended to be added to the fuel tank, which should be at least half full. Next with the engine off, a user should locate a centrally positioned manifold vacuum port on the engine that is part of the intake manifold plenum, so as to insure that each cylinder to be treated receives an equal amount of the to be introduced cleaning composition. Subsequently, the engine is started and the inventive cleaning composition is applied for about thirty seconds. The engine is then turned off, and the product is allowed to soak for ten minutes. The engine is then restarted and another application cycle of thirty seconds with a ten minute soak break is repeated for at least four application cycles, or until desired engine performance is obtained. During the application cycles, a user should note the engine revolutions per minute (RPM), and the stalling of the engine should be avoided. Some engines may require to be kept at approximately 1200 RPM during product application, while smaller engines may require short bursts of the inventive cleaning composition so as not to overload the engine. Following the application cycles of the inventive engine valve deposit removal composition, with the engine off a liquid air intake cleaner is connected with a coupling tool to the same vacuum port used for the deposit cleaning The engine is then started and the engine speed is increased to 1200 RPM, and the valve on the coupling tool is slowly opened to allow the liquid air intake cleaner to be drawn into the engine. Application of the air intake cleaner is complete when the cleaner is depleted, and then the engine is shut off. Hose connections and engine covers are then restored to normal operating placements, and the vehicle should be test driven for approximately five minutes to clear the engine and exhaust of residual cleaning products. If necessary, the engine codes should be cleared to turn off diagnostic indicators on the dash display, and the application procedure is complete when engine RPM returns to normal operating range, and all codes are erased.

An inventive composition particularly well suited for cleaning an intake manifold of an engine is also provided. The composition is a solvent mixture of aromatic hydrocarbons, lipophilic solvent, and a mutual solvent. $C_{10}$-$C_{28}$ fatty acid methyl esters represent a majority of the lipophilic solvent in certain inventive embodiments. Glycol ethers and esters represent the mutual solvent in certain inventive embodiments. The solvent mixture includes a quantity of ammonium soap and water present in amount of more than 5 weight percent of the composition. For the purposes of determining solvent weight percent, only the hydrophobic solvents phase components are considered. The hydrophobic solvent phase for weight percent computation is distinct from the surfactants and the aqueous phase.

Aromatic hydrocarbons typically constitute between 5 and 80 solvent weight percent and in other embodiments is present from 5 to 35 solvent weight percent. Aromatic hydrocarbons operative herein illustratively include AROMATIC100, that is predominantly isomers of trimethyl benzene; toluene; xylene; benzene; AROMATIC150; AROMATIC200; and combinations thereof.

Lipophilic solvents typically constitute between 10 and 90 solvent weight percent and in other embodiments is present from 10 to 55 solvent weight percent. Fatty acid esters operative herein in particular include methyl esters that are also conventionally termed biodiesel; however it is appreciated that ester alkyl moieties that are $C_2$-$C_8$ such as ethyl, propyl (n-propyl), isopropyl (i-propyl), butyls, pentyls, hexyls, heptyls, octyls, and combinations thereof are also miscible with the hydrophobic solvent phase components. Specific fatty acids that form trigylcerides of a fatty acid ester operative herein illustratively include, in general order of increasing molecular weight and degree of saturation: lauric, myristic, palmitic, palmitoleic, stearic, oleic, linoleic, arachidic, gadoleic, behenic, erucic, lignoceric, nervonic. And combinations thereof. Conventional sources of fatty acids are plant oils such as palm, olive, peanut, rapeseed, soybean, sunflower, grapeseed, almond, and corn. It is appreciated that the fatty acid esters are readily replaced in part or completely as the lipophilic solvent with kerosene, $C_8$-$C_{22}$ alkane petroleum distillates, or a combination thereof.

Mutual solvents typically constitute between 10 and 90 solvent weight percent and in other embodiments is present from 5 to 60 solvent weight percent. The mutual solvent has solubility of at least 10 parts by weight of mutual solvent in both the aromatic solvent and water. Specific examples of mutual solvent operative herein illustratively include diethylene glycol dialkyl ether; dipropylene glycol; $(C_1$-$C_6$ alkyl$)_2O$ ethers; ethoxypropanol; butyl glycol; ethylene glycol, propylene glycol; and ketones, such as methyl ethyl ketone, acetone, cyclohexanone; N-methylpyrrolidone, N-ethylpyrrolidone, and combinations thereof.

Upon forming a hydrophobic solvent phase, ammonium soap (tall oil fatty acids and ammonium hydroxide) is present from 0.1 to 10 total weight percent and water to over 5 total weight percent are added. In some embodiments, water is present from 6 to 10 total weight percent, while in other embodiments from 10 to 25 total weight percent.

An inventive composition is amenable to inclusion of various additives such as stabilizers, colorants, and corrosion inhibitors. Typically these additives if present are used in amounts of 0.01 to 3 total weight percent of the composition. Corrosion inhibitors operative herein illustratively include hexamine, phenylenediamine, dimethylethanolamine, sodium nitrite, cinnamaldehyde, imines, chromate salts, nitrite salts, phosphate salts, hydrazine, quaternary amines, and ascorbic acid.

The inventive composition is particularly effective at removing carbonaceous deposits. This is especially true under the rigors of combustion. The soap and mutual solvent enable the water to for solution or storage stable suspension, with storage stability at 20° C. for month than 3 months. This de-carbonizing composition is amenable to packaging in a bottle, pump spray or as an aerosol. The de-carbonizing composition is delivered by a long tube and nozzle to combustion equipment such as an intake manifold or a combustion chamber. Propellants operative herein illustratively include a mixture of butane and propane. The composition is applied as a foam which quickly disperses to a clear solution.

The foregoing description is illustrative of particular embodiments of the invention, but is not meant to be a limitation upon the practice thereof. The following claims, including all equivalents thereof, are intended to define the scope of the invention.

The invention claimed is:

1. A process for cleaning an intake manifold of an engine to remove carbon deposits, comprising the steps of:

applying a de-carbonizing composition comprising a hydrophobic phase solvent mixture of aromatic hydrocarbons, lipophilic solvent, and a mutual solvent, wherein said aromatic hydrocarbons are selected from the group consisting of: trimethyl benzene, toluene, xylene, benzene, and combinations thereof; said lipophilic solvent is selected from the group consisting of a $C_{10}$-$C_{28}$ fatty acid methyl ester, kerosene, $C_8$-$C_{22}$ alkane petroleum distillates, and a combination of said kerosene and said $C_8$-$C_{22}$ alkane petroleum distillates; and said mutual solvent is selected from the group consisting of: diethylene glycol dialkyl ether, dipropylene glycol, $(C_1$-$C_6$ alkyl$)_2$-O ethers, methyl ethyl ketone, acetone, cyclohexanone; N-methylpyrrolidone, N-ethylpyrrolidone, and combinations thereof; ammonium soap; and water present in amount of more than 5 total weight percent of the composition to the intake manifold of the engine during operation of said engine for a first time period to remove the carbon deposits from said intake manifold of the engine;

turning off the engine for a second time period; and restarting the engine to draw the removed carbon deposits and said de-carbonizing composition into a combustion chamber of the engine to clean the intake manifold.

2. The process of claim 1 wherein said composition is applied through a tube of the intake manifold.

3. The process of claim 1 wherein said composition is applied as a foam.

4. The process of claim 1 wherein said composition is applied as a spray.

5. The process of claim 1 wherein said composition is applied as an atomized mist.

6. The process of claim 1 further comprising repeating the applying and turning off steps at least one additional time.

7. The process of claim 1 wherein the second time period is 1 to 30 minutes and greater than the first time period.

8. The process of claim 1 wherein said de-carbonizing composition is packed in an aerosol propellant.

9. The process of claim 1 wherein said de-carbonizing composition and the removed carbon deposits chemically react in said combustion chamber under combustion conditions.

10. The process of claim 1 wherein said de-carbonizing composition is applied to a centrally positioned manifold vacuum port of the intake manifold.

11. The process of claim 1 wherein said first time period is 30 seconds.

12. The process of claim 1 further comprising maintaining the engine at 1200 revolutions per minute (RPM) during said applying step.

13. The process of claim 1 further comprising introducing a liquid air intake cleaner following completion of use of said de-carbonizing composition to the manifold.

14. The process of claim 6 wherein the repeating is done 2 to 4 times.

* * * * *